US005115163A

United States Patent [19]

Fitzpatrick et al.

[11] Patent Number: 5,115,163

[45] Date of Patent: May 19, 1992

[54] CATHODE RAY TUBE DEVICE WITH IMPROVED COOLANT

[75] Inventors: Brian J. Fitzpatrick, Ossining; Phyllis M. Harnack, Hastings on Hudson, both of N.Y.; Scott H. Baker, Knoxville, Tenn.

[73] Assignee: North American Philips Corporation, New York, N.Y.

[21] Appl. No.: 603,973

[22] Filed: Oct. 23, 1990

[51] Int. Cl.[5] ..... H01J 61/52

[52] U.S. Cl. ..... 313/36; 313/35; 313/44; 313/477 R; 313/478; 252/79; 252/174.21

[58] Field of Search ..... 313/36, 35, 44, 112, 313/477 R, 478; 358/250; 252/73, 79, 174.21, DIG. 1, DIG. 14

[56] References Cited

U.S. PATENT DOCUMENTS

| | | | |
|---|---|---|---|
| 3,809,152 | 5/1974 | Boehmer | 252/73 X |
| 4,360,443 | 11/1982 | Durr, Jr. | 252/73 X |
| 4,518,512 | 5/1985 | Kanamori | 252/38 X |
| 4,617,490 | 10/1986 | Fitzpatrick et al. | 313/478 |
| 4,699,727 | 10/1987 | Dexheimer | 252/79 X |
| 4,755,716 | 7/1988 | Hayafune et al. | 313/478 |
| 4,767,568 | 8/1988 | Abel et al. | 252/321 |
| 4,945,282 | 7/1990 | Kawamura et al. | 313/478 X |

FOREIGN PATENT DOCUMENTS

| | | | |
|---|---|---|---|
| 0689803 | 6/1964 | Canada | 252/73 |

*Primary Examiner*—Donald J. Yusko
*Assistant Examiner*—Ashok Patel
*Attorney, Agent, or Firm*—Norman N. Spain

[57] ABSTRACT

A cathode-ray tube device for generating a bright light spot is provided, in the path of radiation, a container with a coolant from the cathode-ray tube containing a solution of about 0.5-2.0% by weight of a surfactant selected from the group consisting of sorbitan esters of fatty acids of 12-18 carbons, polyoxyethylene derivatives thereof and ethers of polyoxyethylene in polyethylene glycol 200-300 all of said container in contact with said solution being formed of polymethyl methacrylate and all surfaces of which container are in contact with said solution are provided with a thin layer of silicon dioxide.

8 Claims, 1 Drawing Sheet

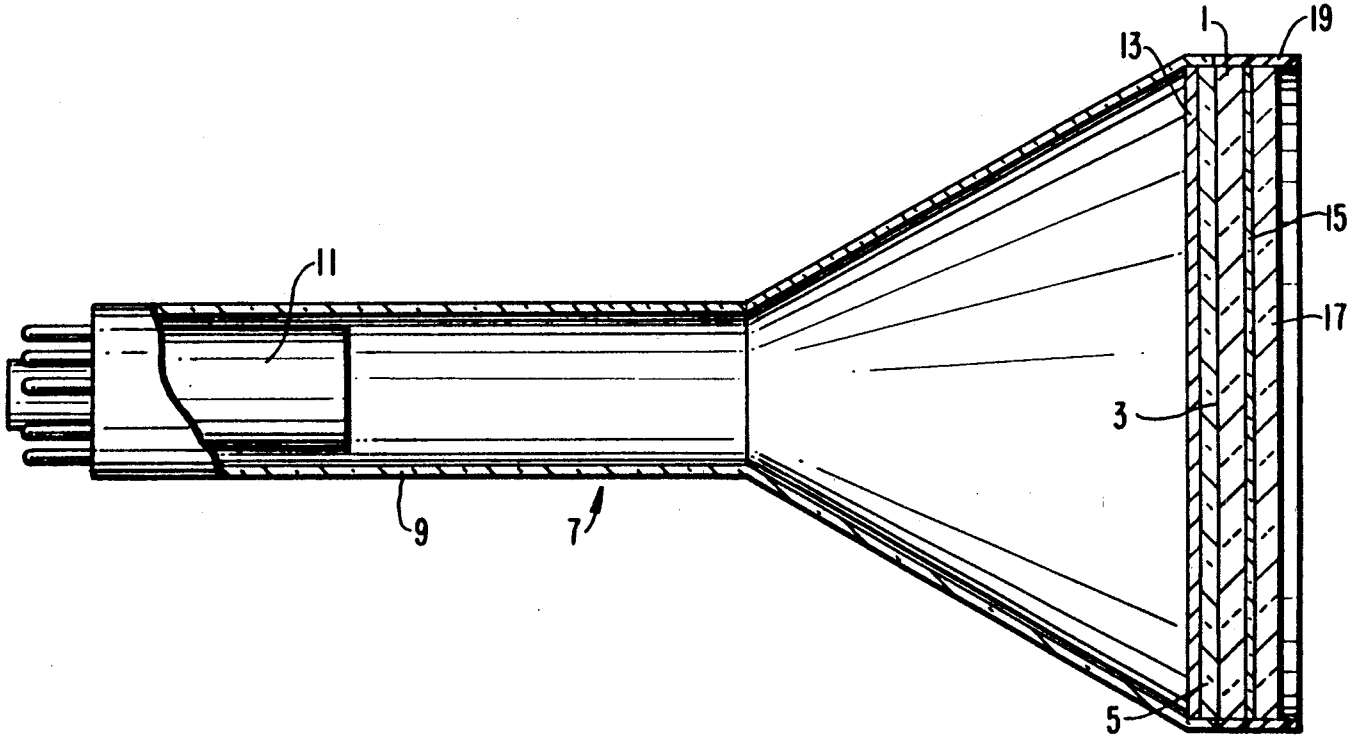
19
15
17
1
13
3
5
7
9
11

CATHODE RAY TUBE DEVICE WITH IMPROVED COOLANT

BACKGROUND OF THE INVENTION

This invention related to a new and novel CRT device for generating a bright color light spot of the type that is particularly useful for projection color television receivers and for information display.

During operation of cathode-ray tube devices which are used for generating a bright color light spot particularly when employed for projection color television, a large amount of heat is generated. This heat is generated at the face plate of the cathode ray tube, the temperature of the center of the face plate reaching 120° C. or higher and the temperature of the phosphor coating of the face plate reaching even higher temperatures. As a result after a short period of operation the phosphor coating is damaged and the cathode ray tube can no longer be employed.

In order to prevent heating of the face plate it is frequent practice to provide a coolant between the outer surface of the face plate and an element such as a lens, provided adjacent to the outer surface of the face plate, for focusing images provided by cathode ray tube.

Masegawa U.S. Pat. No. 4,725,755, col. 20 shows use of a mixture of ethylene glycol and 20% to about 40% by weight of glycerol as a coolant provided between the lens and the face plate of the cathode-ray tube.

However, the index of refraction of this coolant (1.444) is insufficiently high as compared to that of the lens which is formed of polymethyl methacrylate (PMMA) face plate of the cathode ray tube. Further this coolant tends to turn yellow after a period of use.

Fukuda et al U.S. Pat. No. 4,824,224 shows the use of polyethylene glycol -200- as such a coolant.

Polyethylene glycol has the advantage of having a higher refractive index (1.459) and thus it tends to avoid formation of a "halo" effect due to a reduced difference in the indexes of refraction between this coolant and the lens. However polyethylene glycol has the disadvantage of insufficiently wetting the polymethyl methacrylate lens.

SUMMARY OF THE INVENTION

A principal object of the invention is to provide a cathode-ray tube device for generating a bright light spot particularly for use in projection television having improved cathode-ray tube cooling means. This and other objects of the invention will be apparent from the description that follows.

According to the invention a cathode-ray tube device of the type described contains as a coolant, between the outer surface of the face plate of the cathode-ray tube and an adjacent PMMA lens, a solution of about 0.5-2.0% by weight of a surfactant selected from the group consisting of sorbitan esters of fatty acids of 12-18 carbons, polyoxyethylene derivatives thereof and ethers of polyoxyethylene and polyethylene glycol 200-300. Further according to the invention the surface of the PMMA lens in contact with the solution is provided with a thin coating of silicon dioxide.

This combination provides the advantages of a higher index of refraction (1.46) and complete wetting of the surface of the lens by the coolant. The silicon dioxide coating prevents etching of the surface of the PMMA lens by the coolant.

BRIEF DESCRIPTION OF THE DRAWING

The sole FIGURE in the drawing is a cross-sectional view of portion of the cathode-ray device of the invention showing the coolant provided between the lens and the face plate of the cathode-ray tube.

DETAILED DESCRIPTION OF THE INVENTION

All surfactants coming within the class mentioned have been found useful is carrying out the invention. Specific examples of such surfactants are sorbitan monolaurate, sorbitan monooleate, sorbitan sesquioleate, sorbitan trioleate, polyoxyethylene (20) sorbitan monolaurate and polyoxyethylene (5.5) decyl ether. Of these sorbitan monolaurate is preferred.

Preferably, the coolant is sorbitan monolaurate dissolved in the polyethylene glycol 200 in an amount by weight of about 1%. The index of refraction of this coolant is 1.46.

The coolants of the invention wet uniformly the silicon dioxide coated surface of the polymethyl methacrylate lens as well as the surface of the face plate.

The silicon dioxide coating may be applied to the surface of the lens by any well known method.

The thickness of the silicon dioxide coating in general is from 400 Å-600 Å with a thickness of about 500 Å being preferred.

For a more complete understanding, the invention will now be described with reference to the sole FIGURE of the drawing.

A coolant solution of 1% by weight of solution monolaurate in polyethylene glycol 200 is prepared. A layer 1 (3 mm thick) of this solution is provided between the external surface 3 of the face plate 5 of a cathode-ray tube 7 provided with envelope 9 and electron gun 11 positioned to direct a stream of electrons on the surface of a fluorescing phosphor screen 13 deposited on the inner surface of the face plate 5, which screen emits visible radiation upon impingement by electrons and a surface of lens 17 opposing face plate 5.

A 500 Å thick coating 15 of silicon dioxide is deposited on the surface of lens 17 opposing the face plate 5. The coating is deposited by electron beam evaporation.

The lens 17 is formed of transparent polymethyl methacrylate.

The layer 1 of the coolant solution completely wets the external surface 3 of the face plate 5 and the coating 15 of silicon dioxide.

The layer 1 of the coolant solution is prevented from leaking from between the face plate 5 and lens 17 by seals 19.

What is claimed is:

1. A cathode-ray tube device for generating a bright light spot comprising:

a cathode-ray tube including an evacuated envelope, means for generating an electron beam, a transparent glass face plate forming part of said envelope and situated in said electronic beam, said transparent glass face plate having an interior surface situated in said electronic beam provided with a phosphor coating capable of emitting visible radiation upon excitation by said electron beam, and a coolant means for said cathode-ray tube positioned outside of said cathode-ray tube, and in a beam of said radiation, said coolant means comprising, in a container which at least in a direction parallel to the axis of said tube is transparent to said visible radiation, a solution consisting essentially of about 0.5–2.0% by weight of a surfactant selected from the group consisting of sorbitan esters of fatty acids of 12–18 carbons, polyoxyethylene derivatives thereof and ethers of polyoxyethylene in polyethylene glycol 200–300, all of said container in contact with said solution being formed of polymethyl methacrylate and all surfaces of which container are in contact with said solution being provided with a thin layer of silicon dioxide.

2. The cathode-ray tube device of claim 1 wherein the surfactant is a member selected from the group consisting of sorbitan monolaurate, sorbitan sesquioleate and sorbitan trioleate.

3. The cathode-ray tube device of claim 1 wherein the solution is a solution of sorbitan monolaurate in polyethylene glycol 200.

4. The cathode-ray tube device of claim 3 wherein the silicon dioxide coating is about 400 Å–600 Å thick.

5. The cathode-ray tube device of claim 4 wherein about 1% by weight of sorbitan monolaurate is present in the solution.

6. The cathode-ray tube device of claim 1 wherein the container is sealed to the outer surface of the face plate and the solution contacts the outer surface of the face plate.

7. The cathode-ray tube device of claim 4 wherein the container is sealed to the outer surface of the face plate and the solution contacts the outer surface of the face plate.

8. The cathode-ray tube device of claim 5 wherein the container is sealed to the outer surface of the face plate and the solution contacts the outer surface of the face plate.

* * * * *